US007637544B2

(12) United States Patent
Liang et al.

(10) Patent No.: US 7,637,544 B2
(45) Date of Patent: Dec. 29, 2009

(54) NIGHT LATCH

(76) Inventors: Luke Liang, 500 Metuchen Rd., So. Plainfield, NJ (US) 07080; Tong Liang, Suite 1712, 195 Yanjiang Road, Guangzhou (CN); David Chen, 1000 Jie Fang Beil Rd., Apt.- C1-304, Guangzhou (CN) 510400

( * ) Notice: Subject to any disclaimer, the term of this patent is extended or adjusted under 35 U.S.C. 154(b) by 0 days.

(21) Appl. No.: 11/506,145

(22) Filed: Aug. 17, 2006

(65) Prior Publication Data

US 2008/0079268 A1 Apr. 3, 2008

(51) Int. Cl.
*E05C 17/44* (2006.01)
*E05B 55/00* (2006.01)

(52) U.S. Cl. ..... 292/338; 292/339; 292/DIG. 20; 292/DIG. 31; 292/DIG. 37; 292/DIG. 47; 49/449

(58) Field of Classification Search ..... 292/338, 292/339, DIG. 20, DIG. 31, DIG. 47, DIG. 37; 49/449

See application file for complete search history.

(56) References Cited

U.S. PATENT DOCUMENTS 769,767 A * 9/1904 Phelps ..... 70/90
804,994 A * 11/1905 Andrews ..... 292/219
1,895,146 A * 1/1933 Brown ..... 292/228
2,077,629 A * 4/1937 Lahr ..... 248/294.1
4,824,154 A * 4/1989 Simpson ..... 292/338
4,923,230 A * 5/1990 Simpson ..... 292/67
5,248,174 A * 9/1993 Matz et al. ..... 292/338
5,465,462 A * 11/1995 Yamada ..... 16/438
5,469,725 A * 11/1995 Yamada ..... 70/208
5,536,052 A * 7/1996 Maier ..... 292/63
5,553,903 A * 9/1996 Prete et al. ..... 292/163
5,556,145 A * 9/1996 Takasaki ..... 292/336.3
5,575,116 A * 11/1996 Carlson et al. ..... 49/449
5,806,900 A * 9/1998 Bratcher et al. ..... 292/137
6,364,375 B1 * 4/2002 Szapucki et al. ..... 292/63
6,572,158 B2 * 6/2003 Szapucki et al. ..... 292/221
2005/0011131 A1 * 1/2005 Liang et al. ..... 49/449

* cited by examiner

*Primary Examiner*—Carlos Lugo
(74) *Attorney, Agent, or Firm*—Thomas A. O'Rourke; Bodner & O'Rourke, LLP

(57) ABSTRACT

A night latch, in particular a night latch that includes a housing, tumbler, button, and a resilient members. The housing of the present invention maintains the tumbler, button, and resilient members. The housing also may have at least one protrusion located on its sidewall. The tumbler of the present invention has a pivoting member along with an aperture for housing a resilient member. In addition, the tumbler of the present invention may have a protrusion located on its front face, which interacts with a protrusion located on the rear end of lower portion of the button. The lower portion of the button also has a resilient member located on the front end. This resilient member exerts a force that maintains the tumbler in a retracted position.

41 Claims, 19 Drawing Sheets

NIGHT LATCH

FIELD OF THE INVENTION

The present invention is directed to the field of window hardware, particularly window hardware for double hung windows.

BACKGROUND OF THE INVENTION

Double hung windows are a common type of window used in many homes and remodelings. There is a frame with a pair of tracks on each side of the frame. There is a top sash and a bottom sash. The top sash typically rides in the outer tracks, i.e. the tracks in the frame closest to the outside of a building. The lower sash rides in the inner track, i.e. that track that is closest to the interior of a house. The sash has a pair of vertical stiles that are joined to upper and lower horizontal styles. One or more panes of glass are retained in the sash. There can be an inner pane and an outer pane that extends from one vertical stile to the other and from one horizontal style to the other. There can be a third pane of glass positioned similarly with a gap between the first and second panes. The gap is usually filled with an inert gas such as argon. This structure provides a window with insulating qualities. One or more muntin bars can be present to provide a look of individual lites in the window of the type that are found in older construction.

In many double hung windows there is an issue of security. There is usually an outer screen that permits cooler air to ventilate into the house during the warmer months. In order to take advantage of the screen however, the bottom pane typically must be in a raised position. Double hung windows are usually provided with a sash lock that locks the lower and upper sash in position so that they cannot be opened from the outside. While this provides some security during the cooler months, the return of warm weather may make it difficult to use the sash lock in many instances. The sash lock has two positions, a locked position and an unlocked position. Thus the resident has a choice to either keep the window in a closed locked position or have the window sash unlocked and thus open to intruders.

In order to provide a means of ventilating a room yet provide some security, there have been a number of night latches and vent stops that have become available in the market. One such sash stop is U.S. Pat. No. 5,248,174 owned by Ashland Products. Another type of sash stop U.S. Pat. No. 4,923,230, owned by Ro Mai. These night latches or vent stops act in a similar fashion. The night latch or vent stop is placed in the face of the upper sash. Depending on the desired amount of ventilation, the night latch can be placed at any position on the face. Once the night latch is secured in the face of the window, the tumbler can be pressed in an inward and upward fashion activating a spring mechanism that will force the tumbler to an exposed position, thus creating the impeding force required to restrict movement of the lower window sash. Other prior art vent stops are U.S. Pat. Nos. 5,553,903 and 5,806,900 both of which are owned by Ashland.

As mentioned previously, the typical prior art vent stop prevented the opening of the lower sash in similar fashions. In the typical prior art the tumbler was held in a locked position via a catch portion located in the housing of the night latch. Thus, if inwardly and upwardly forces were applied perpendicularly to the face of the tumbler, these forces would release the tumbler from its locked, inactivated position, to its unlocked, activated position.

While the tumblers in the prior art night latches are capable of preventing the sliding member from moving passed a certain predetermined position, these tumblers have an unfavorable characteristic. That is in the prior art vent stop, in order for the user to free the tumbler from its inactivated position to its activated position or vice versa. the user must apply a multitude of forces in a variety of different angles.

Although the night latch and/or vent stops are capable of preventing the lower sash from moving passed a certain desired position, their utility is unfortunately outweighed by their inherent clumsy composition. The night latch in the present invention improves on the prior art shortcomings by implementing a unique method of activating and inactivating the tumbler from the housing, without taking away from its utility and its aesthetic quality.

OBJECTS OF THE INVENTION

It is an object of the present invention to provide a night latch that operates more easily then the prior art night latches.

It is an object of the present invention to provide an improved night latch that is more reliable in its operation then the prior night latches.

It is an object of the present invention to provide a night latch that allows the user to more readily reposition the tumbler back in an inactivated position.

It is still another object of the invention to allow the user the ability of activating the tumbler without the use of multiple forces to release the tumbler.

It is a still further object of the present invention to provide for a more durable night latch, so as to allow for a longer period of operability.

It is still a further object of the invention to provide a release mechanism for activating the tumbler from a recess position to an activated position.

SUMMARY OF THE INVENTION

The present invention is an improved night latch or sash controlling mechanism. The improved night latch can be used with a variety of windows and doors, including but not limited to, single hung windows, double hung windows, sliding windows and doors, etc. The windows can be of the type that moves vertically or horizontally. If the windows are to move in a vertical fashion then the window will have upper and lower sashes situated in the frame of the window. If the windows are to move horizontally, then the windows will have right and left sashes situated in the window frame. A night latch for a sliding door can be installed and operated in the same manner as the sliding window, except the doors will sit in the door frame rather than a window frame. More specifically, this invention is directed to be an integral part of a sliding window or door, that is simple, inexpensive, and ergonomically superior to the prior art.

In the present invention the night latch has three primary components a tumbler, button for activating the tumbler, and a housing that will accommodate the tumbler and the button. The housing is placed in a groove or recess on the face of the upper window sash. The housing is constructed so as to make for a tight, smooth, and finished appearance when inserted into the groove of the window sash. This fit will make for a aesthetically pleasing appearance.

As in the prior art, a tumbler is generally used as the stopping mechanism in the night latch. In general, the tumblers are activated by applying an outside force in a multitude of ways directly to the tumbler, making for a rather difficult and sometimes impossible task. One example of this is when the spring inside the tumbler is new and rather tight. In the present invention the tumbler is activated via a separate button, located on the housing of the night latch. This allows the user to activate the tumbler with relative ease. The button in the present invention is moved laterally, not inwardly as typical in the prior art, by laterally is meant a button having a direction of motion to activate the tumbler that is generally parallel to the upper surface of the housing. The direction of the force applied depends on how the button is configured.

In addition to the relative ease of operation of the improved night latch, the improved night latch has an operational cover located on the bottom of the housing, which allows for installing parts inside of the housing, by operational is meant the cover may be opened and closed. In some prior art the housing is open, thus exposing the inside parts, such as the tumbler and spring, to the outside weathering elements, such as moisture in the air, which could cause malfunction of the night latch, i.e. rusty spring.

Furthermore, the night latch can be recessed with even less effort then many prior art tilt latches. If the user wished to close the night latch in the prior art, the user would have to exert an inward and downward force to deactivate the night latch. This is because the tumbler in the prior art is kept depressed via the face of the tumbler and the top plate of the housing. As mentioned previously application of these forces can prove to be rather burdensome when the night latch was fairly new. In the present improved night latch, the only force needed is a downward force, this is because of the coaction between the tensed bottom part of the button and the bottom protruding portion of the tumbler. The protruding portion of the tumbler serves a twofold function, first, it keeps the tumbler in a locked inactivated position, second, when the button is depressed it keeps the tumbler in a locked activated position.

BRIEF DESCRIPTION OF THE DRAWINGS

FIG. 3(*b*) is an exploded view of the tumbler and spring, with spring inside of cavity of the tumbler of the present invention;

FIG. 4(*b*) is a perspective view of night latch of the present invention with tumbler exposed;

FIG. 5(*b*) is a side view of housing, exposed tumbler, and button mechanism set in housing of the present invention;

FIG. 6(*b*) is an inverted view of housing, exposed tumbler, and active cover in the closed position of the present invention;

FIG. 7(*b*) is an exploded view of the sliding member frame, groove in sliding member frame, and night latch being set in groove of the present invention;

FIG. 7(*c*) is a perspective view of the night latch of the present invention and sliding member frame, such as a window sash or doorframe with tumbler in the closed position;

FIG. 8(*b*) is a cross-sectional view of tumbler and housing, with tumbler exposed;

FIG. 9(*b*) is a cross-sectional view of tumbler and housing, with tumbler depressed and cover open;

FIG. 10(*b*) are right and left side views of tumbler of the present invention.

FIG. 10(*c*) is a perspective view of the button of the night latch of the present invention;

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. All citied references are incorporated herein by reference in their entireties. Citation of any reference is not an admission regarding any determination as to its availability as prior art to the claimed invention.

Figure 1A:
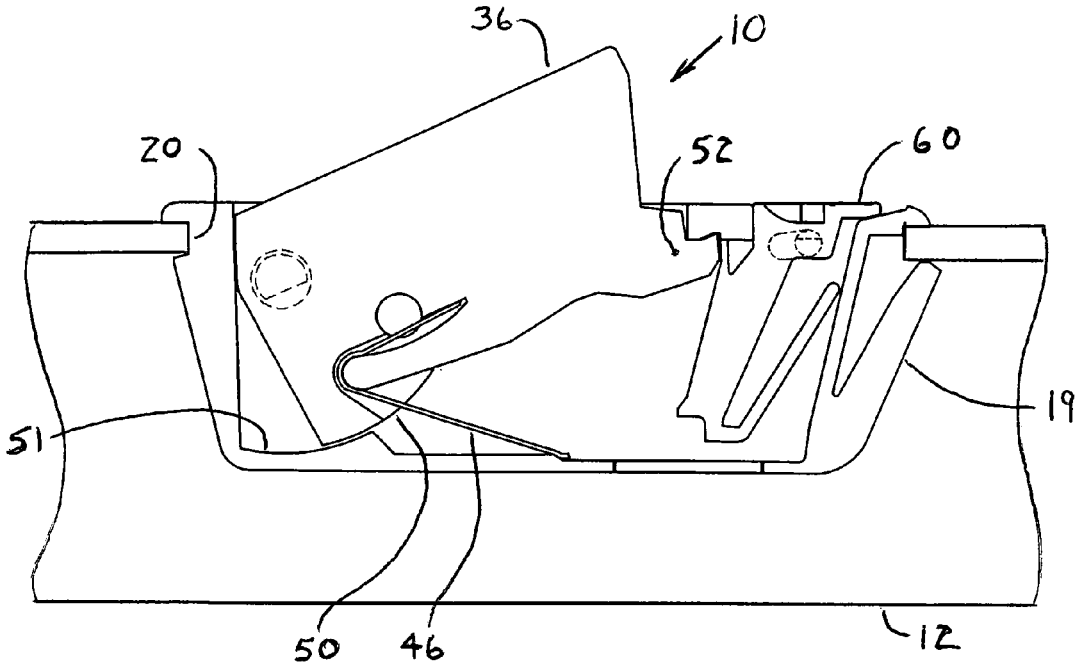
FIG. 1A is a cross-sectional view of the night latch of the present invention in place in a portion of a sliding member frame with tumbler exposed.
Figure 1B:
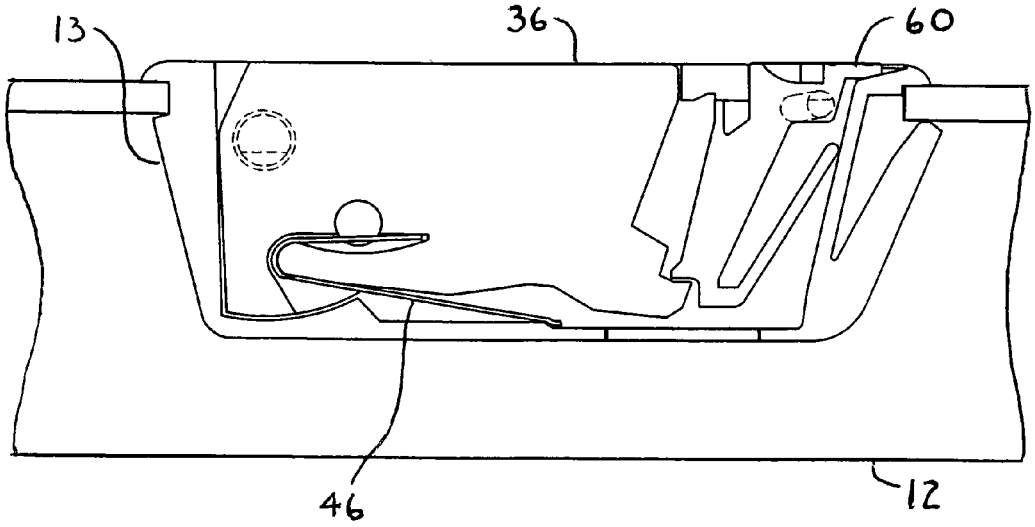
FIG. 1B is a cross-sectional view of the night latch of the present invention in place in a portion of a sliding member frame with tumbler depressed.
Figure 2:
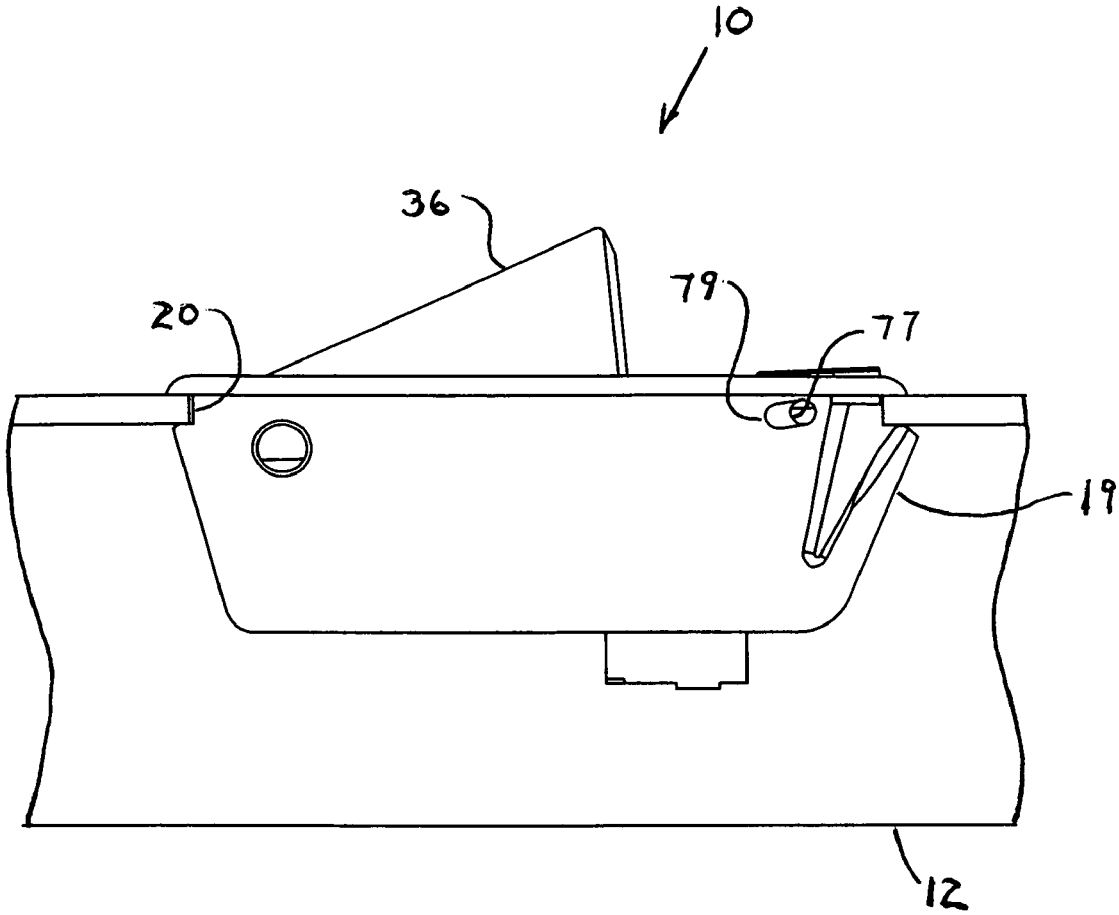
FIG. 2 is a side view of night latch with the tumbler exposed of the present invention.
Figure 4:
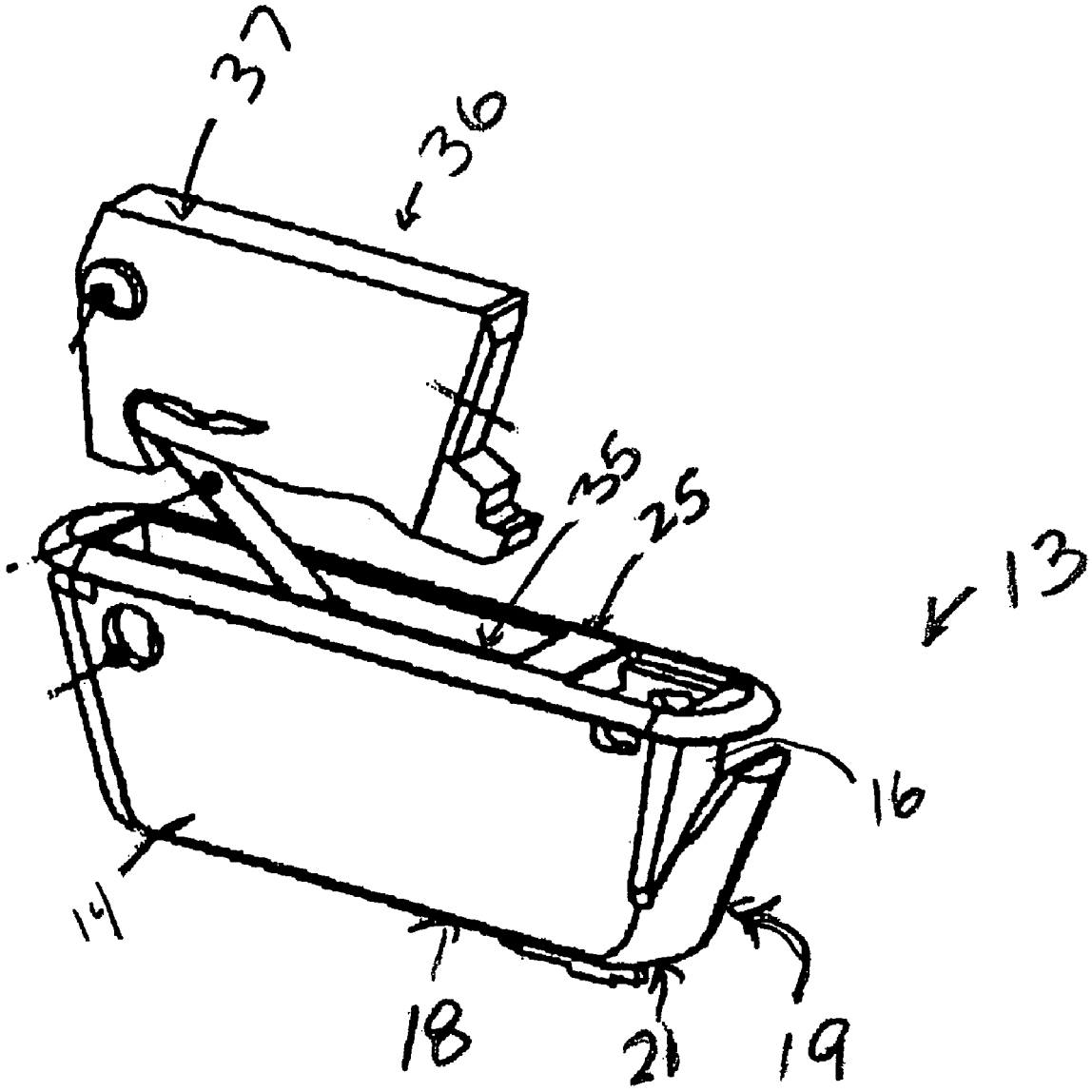
FIG. 4(*a*) is an exploded view of the tumbler, spring, and housing of the present invention.
Figure 4B:
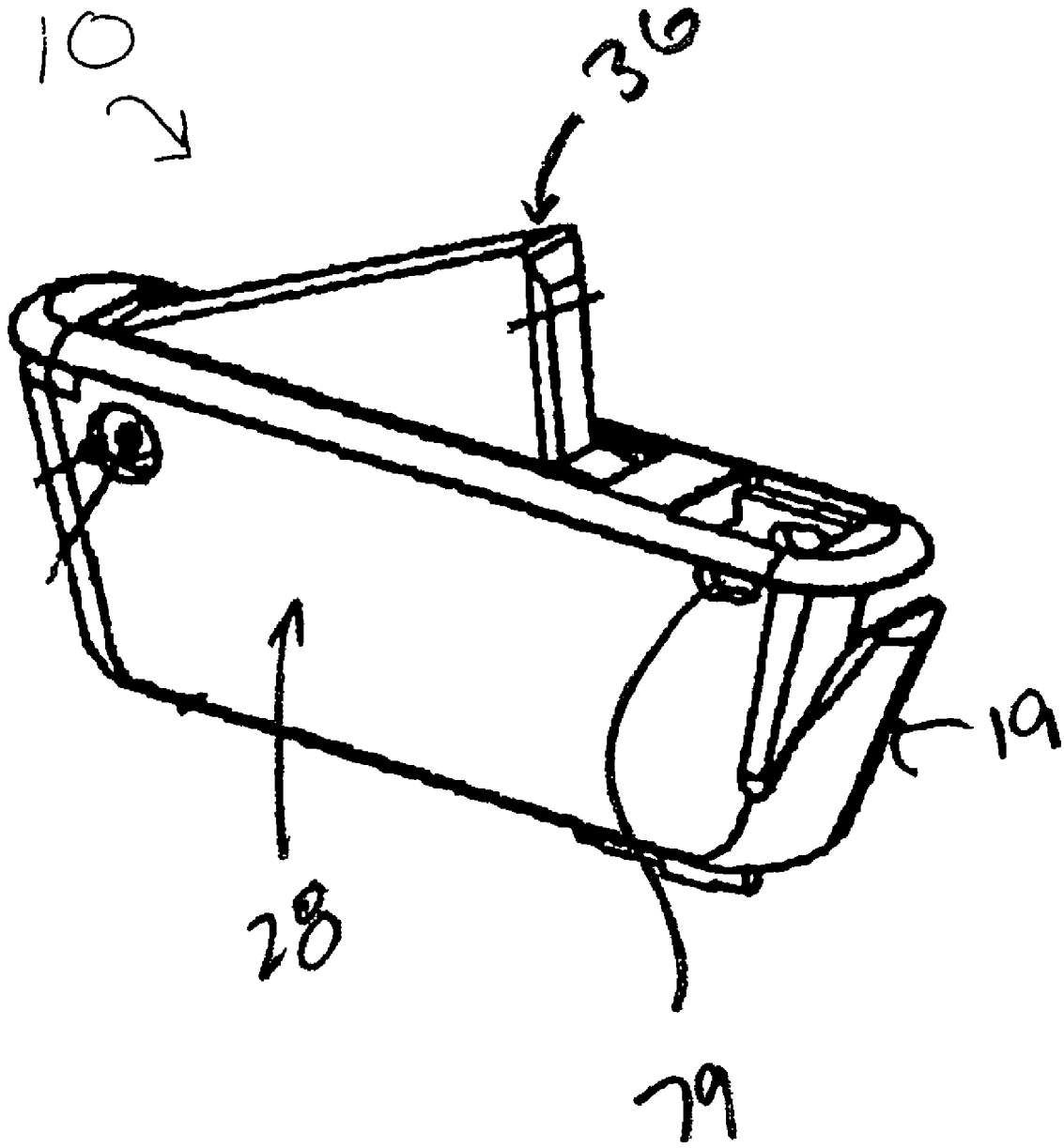
Figure 7:
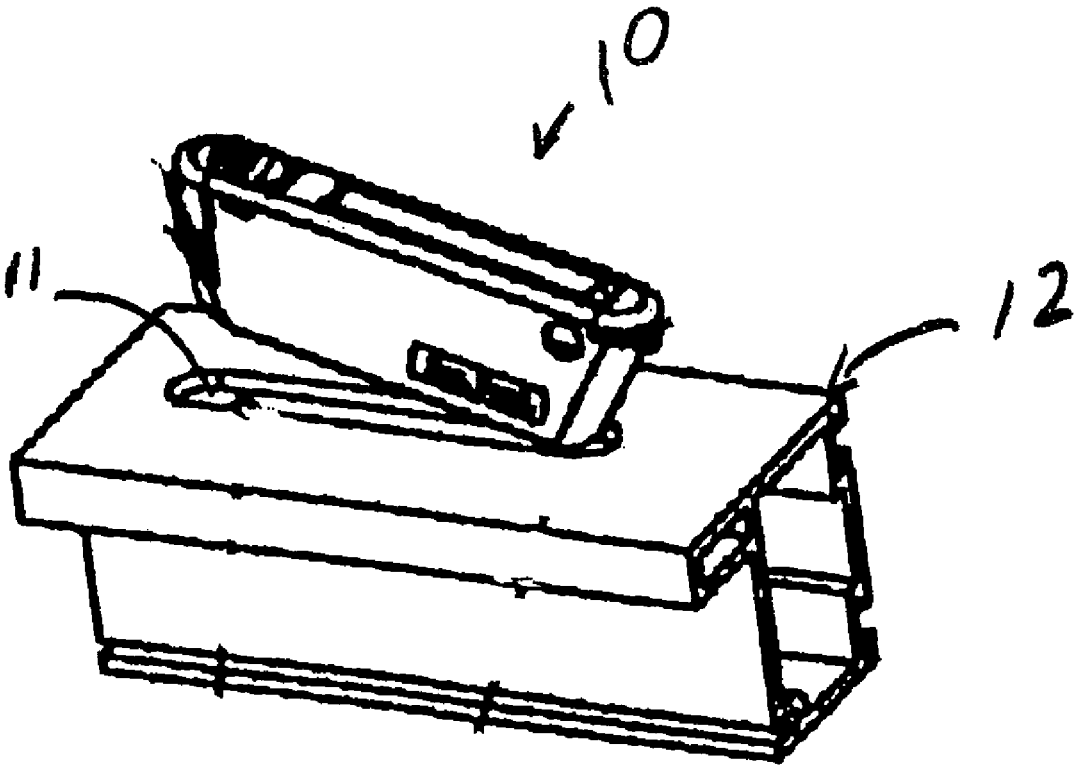
FIG. 7(*a*) is an exploded view of the sliding member frame, groove in sliding member frame, and night latch of the present invention.
Figure 7B:
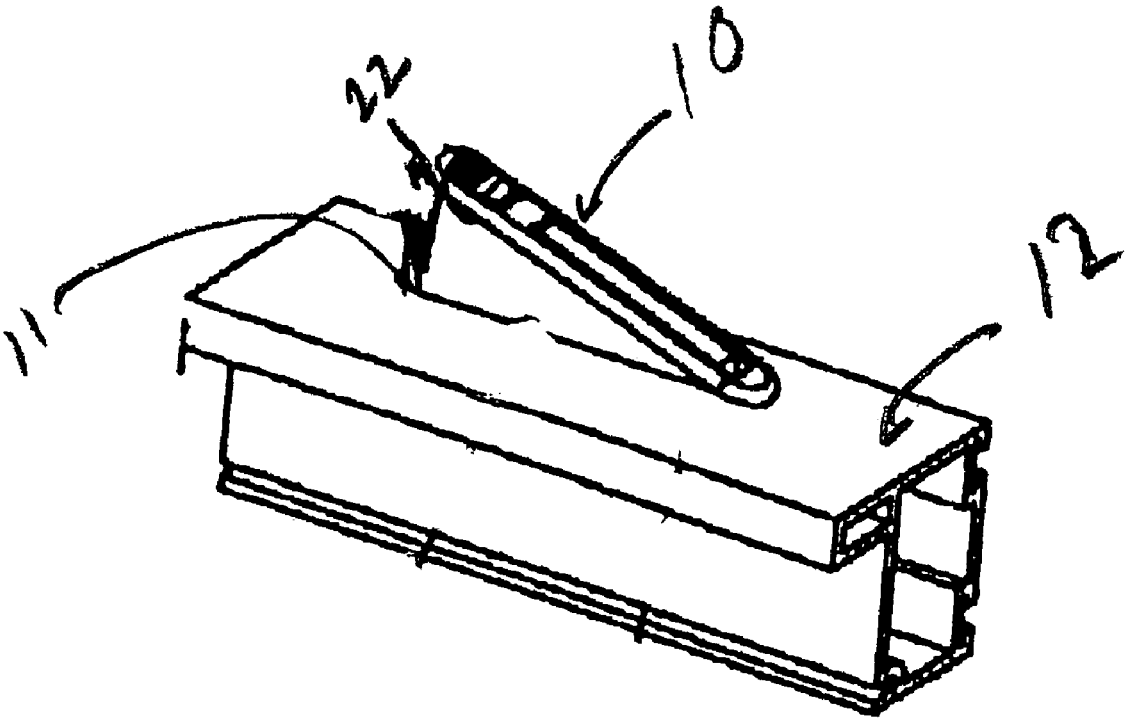
Figure 7C:
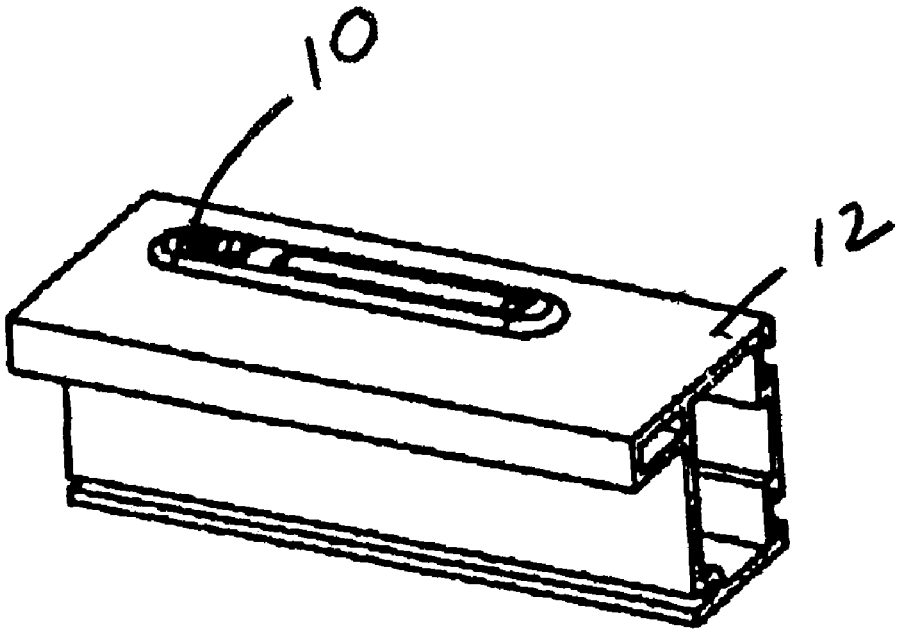

In FIGS. 1, 2, and 4(*b*), the night latch of the present invention is shown generally at 10. As seen in FIG. 7(*a*), the night latch 10 is shown positioned over a slot 11 in sliding member 12. The slot 11 is shown as having an oval shape, but any other suitable shape and size slots including but not limited to a square, rectangle, oval, etc. can be used depending on the shape of the latch. Preferably, however, the night latch 10 of the present invention will have a portion similarly shaped to the slot 11 as to present a clean appearance when placed in the sliding member 12, as seen in FIG. 7(*c*). In the present embodiment an oval shape for illustration purposes was used. The sliding member can be a sash, doorframe, or any other member that has another piece sliding relative to it, where restriction of the full range of movement of the sliding members is desired. Member 12 may also be permanently fixed so that relative motion occurs through motion of the adjacent member only. The tumbler 36 can be either in a raised or lowered position. When raised it prevents further movement of the door or sash.

Figure 6A:
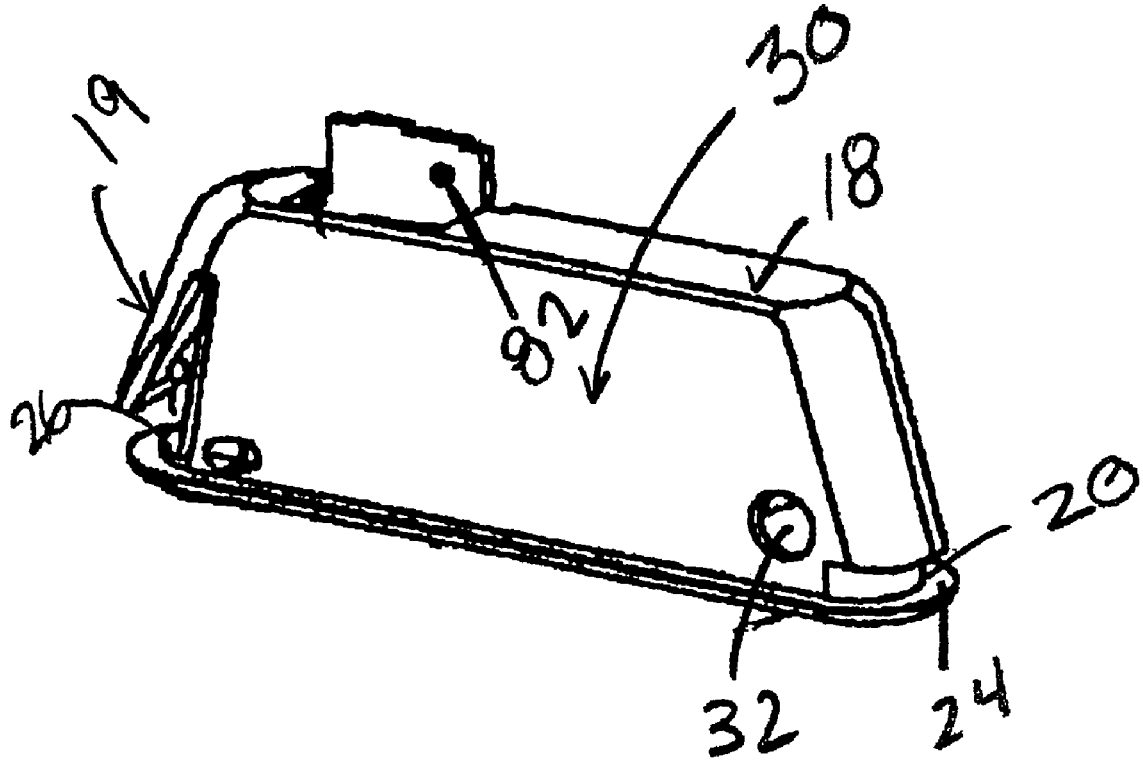
FIG. 6(*a*) is an inverted view of housing, exposed tumbler, and active cover in the open position of the present invention.
Figure 6B:
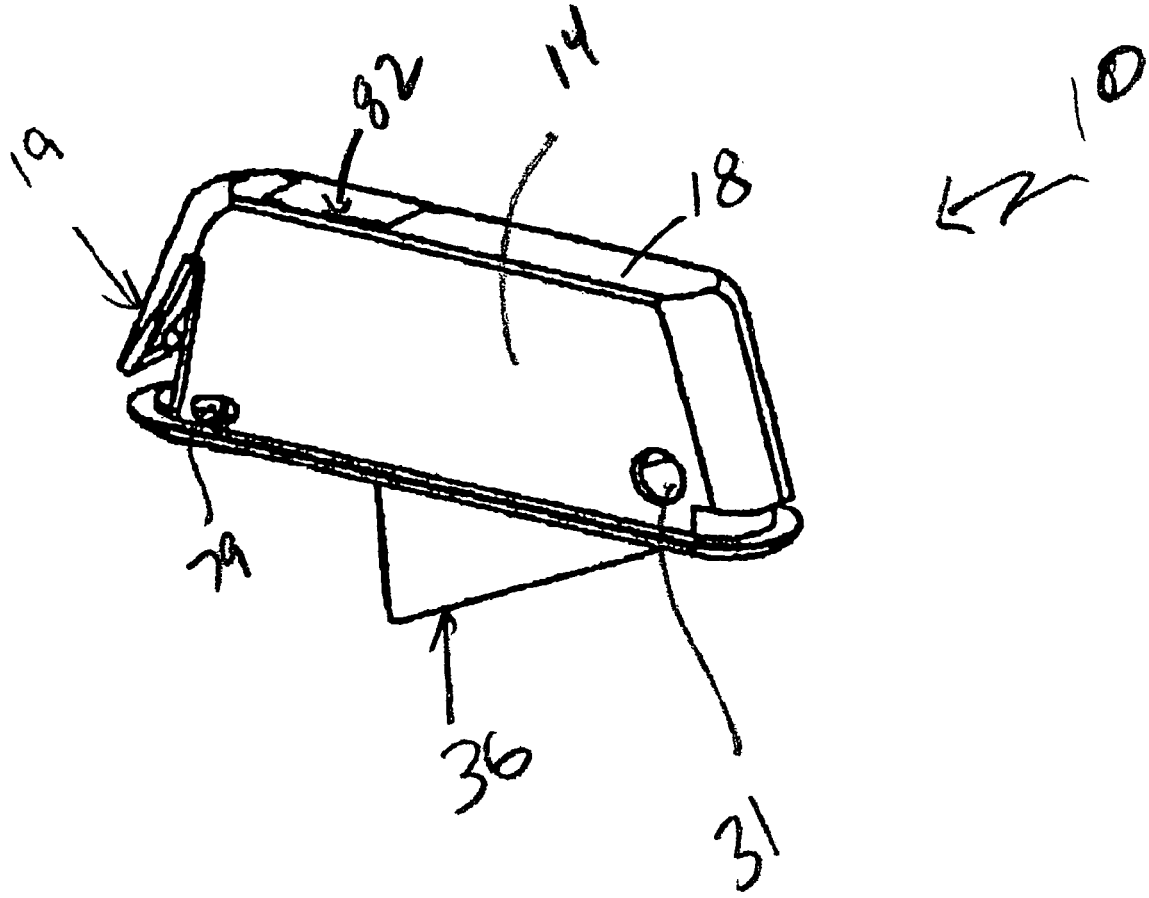

FIG. 4(*a*) is a more detailed view of the contemplated night latch. A housing 13 is generally defined by a first sidewall 14, and a second sidewall 15, not shown, and a front wall 16, and a rear wall 17, and a bottom wall 18, as shown in FIGS. 6(*a*) and 6 (*b*). Bottom wall 18 can also serve as a cover. It is noted that the terms "front" and "rear" are used only for descriptive purposes. Sidewalls 14 and 15 are preferably the same length, as are front and rear walls 16 and 17, respectively, providing for a preferably trapezoidal shape to housing 13. Preferably, when in place within slot 11, sidewalls 14 and 15 contact the edges of slot 11 to provide for a tight fit, and prevent a lateral movement of the night latch 10 within slot 11. Front wall 16 can have a front flexible clip 19 and rear wall 17 can have a rear flexible clip In the present embodiment there is only one flexible clip, front flexible clip 19, as seen in FIG. 2. Rather then use a rear clip; one can use a rear notch 20 to produce generally the same fastening effect as a rear clip, as seen in FIGS. 2 and 6(*a*). The rear notch 20 is of a non flexible nature, it is located at the end of the housing 13, it is created between a surface 26, which runs parallel to lip 23, and the bottom surface 24 of the top plate 25. Front flexible clip 19 can extend generally in an upward fashion, originating at or near the bottom surface 21 of housing 13 and ending typically just below top plate 25, as seen in FIG. 4(*a*). When the night latch is 10 is depressed into slot 11 on a sliding member 12, notch 20 and flexible clip 19 can engage a portion of the member 12, as seen in FIGS. 1, 7(*b*), and 7 (*c*). This engagement can prevent vertical (front and back) movement of the night latch 10 within the member 12, as well as preventing the night latch 10 from being easily dislodged from slot 11.

Figure 5A:
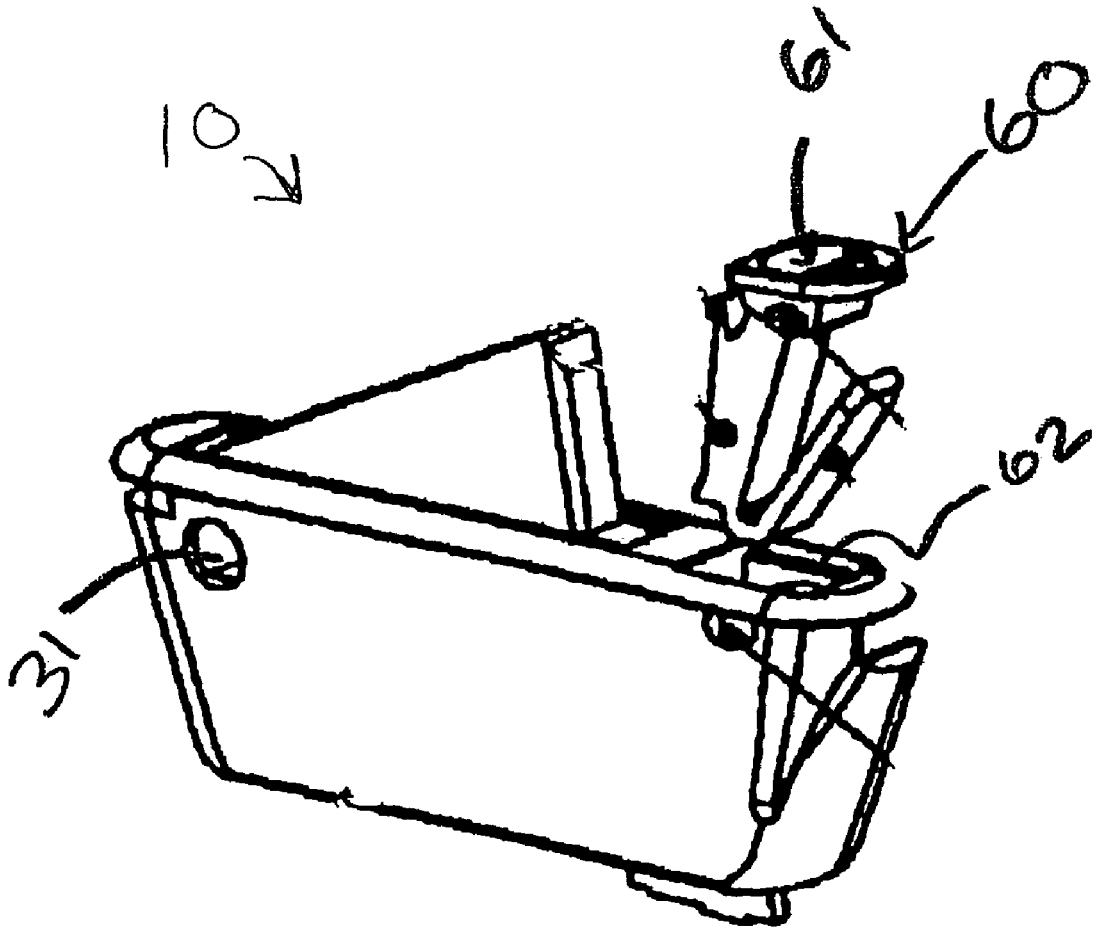
FIG. 5(*a*) is an exploded view of housing, exposed tumbler, and button mechanism of the present invention.
Figure 5B:
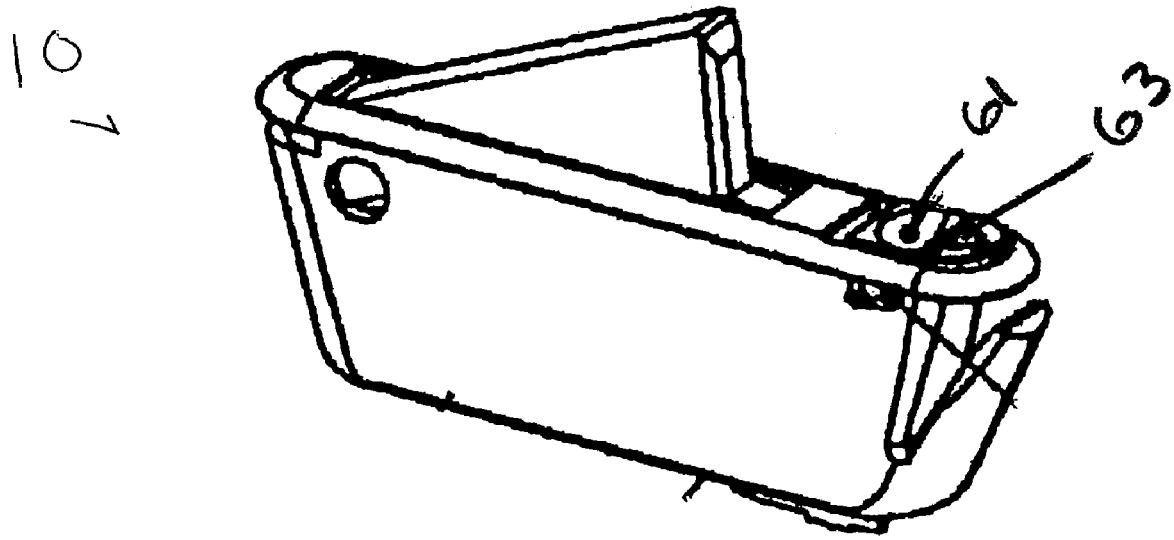

First sidewall 14 has an inner surface 27, not shown, and outer surface 28 as seen in FIG. 2. Second sidewall 15 has inner surface 29, not shown, and outer surface 30, as seen in FIG. 6(*a*). On sidewalls 14 and 15 there exists two apertures, 31 and 32 respectively, as seen in FIGS. 5(*a*) and 6(*a*), respectively. Preferably, apertures 31 and 32 are aligned along the same central axis and are positioned towards rear wall 17. These apertures are designed so as to allow tumbler 36 to pivot or rotate in an outwardly fashion to an actuated position.

The lip 23 attached to top plate 25 is preferably at least the same size or larger and the same general shape as slot 11. Thus, when night latch 10 is placed into slot 11, lip 23 will contact at least the edges of slot 11 or over spread the upper surface of the member 12. These dimensional attributes will allow for a tight fit that will exhibit a finished smooth exterior, which can be aesthetically pleasing. Although top plate 25 is referred to as a "plate", it is understood that housing 13, clip 19, lip 23 and top plate 25 can be integral pieces, without any need for adhesives or assemblage.

Figure 8A:
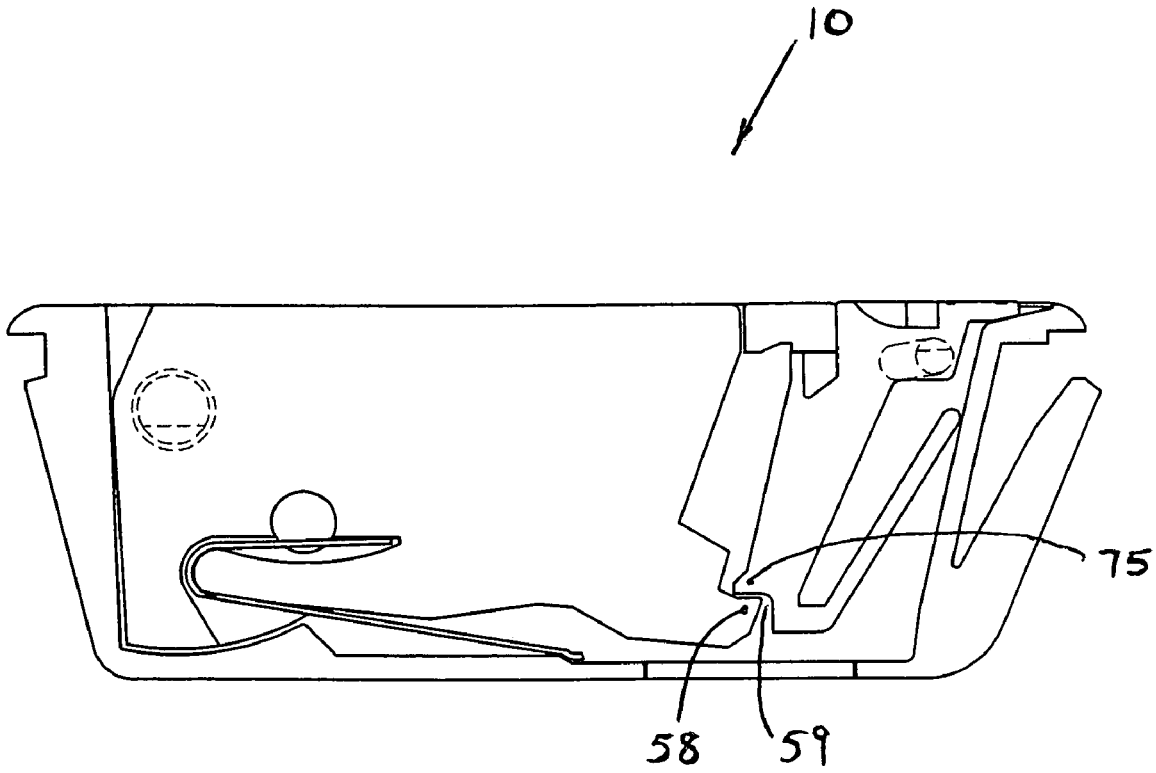
FIG. 8(*a*) is a cross-sectional view of tumbler and housing, with tumbler depressed.
Figure 8B:
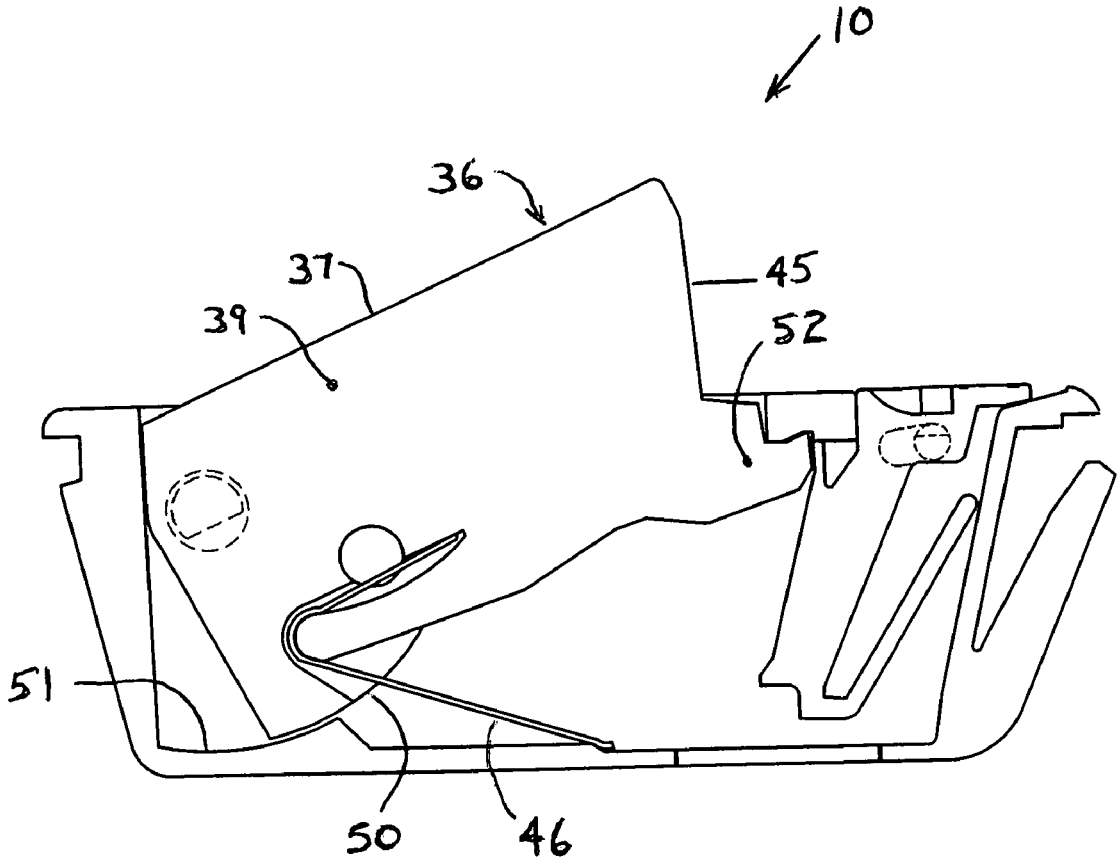
Figure 10C:
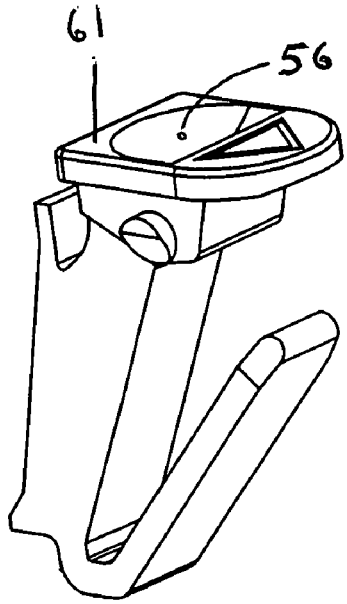
FIG. 10(*a*) is a side view of protruding portion and axle of night latch.
Figure 10A:
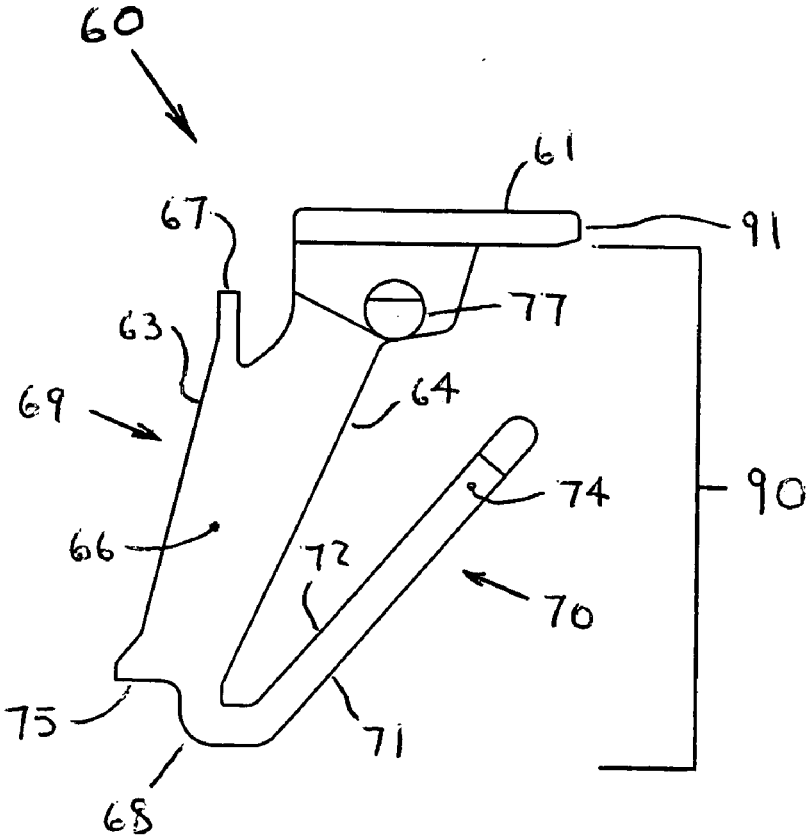
Figure 10B:
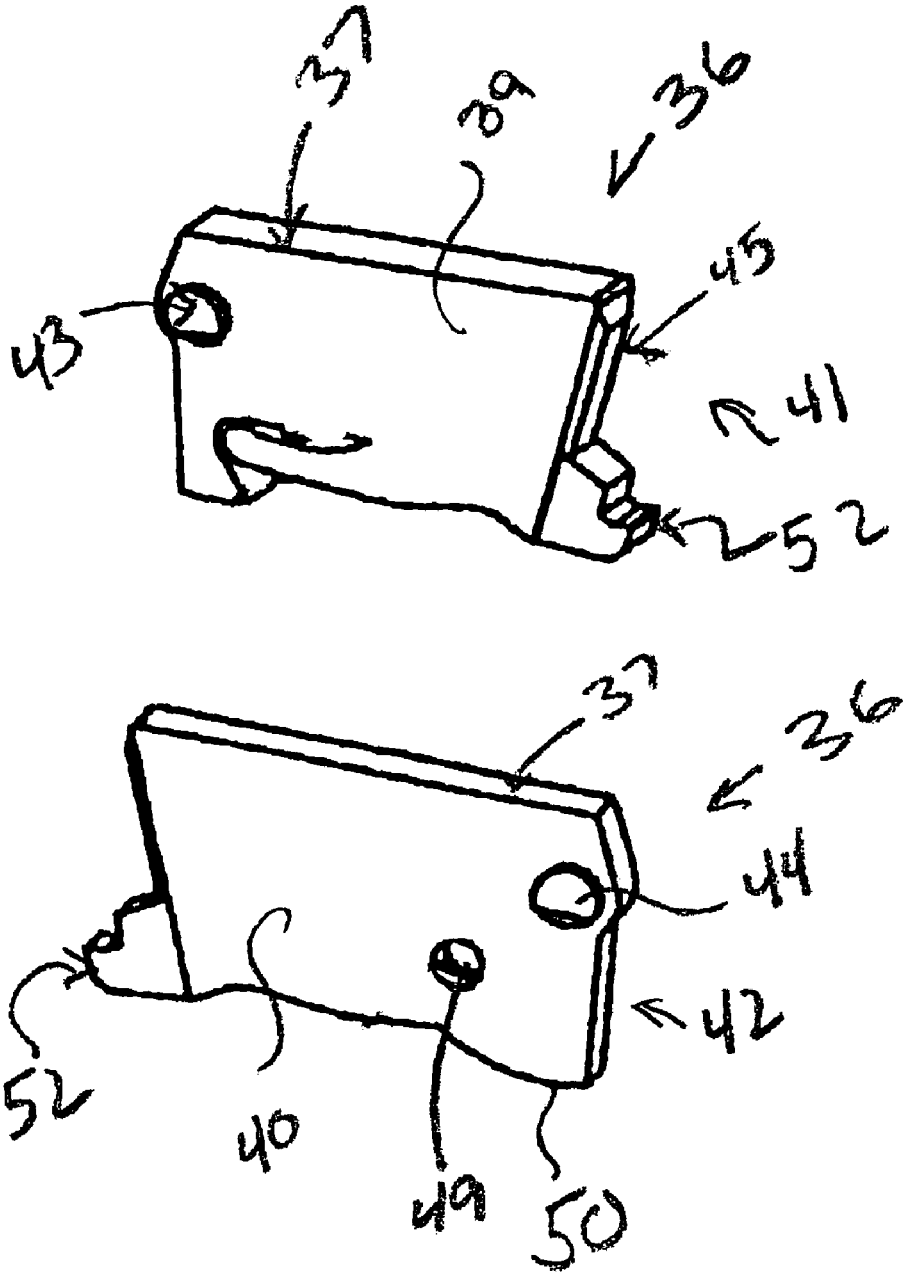

A tumbler 36 is preferably designed to fit within cavity 35 of housing 13, as seen in FIG. 4(*a*). Tumbler 36 may have an upper surface 37, which is preferably smooth and/or flat, as seen in FIG. 10(*b*). A flat surface 37 will exhibit a more finished look for the night latch 10 when it is placed in sliding member 12. Tumbler 36 can have a front end 41 and a rear end 42, along with side surfaces 39 and 40. Tumbler 36 can have rotation members 43 and 44, which can fit in apertures 31 and 32 respectively. The rotation members 43 and 44 can be located on side surfaces 39 and 40, respectively, close to rear end 42. Preferably, rotation members 43 and 44 are cylindrical pegs, which protrude from side surfaces 39 and 40 of tumbler 36, respectively. The rotation members 43 and 44 can allow tumbler 36 to extend outwardly, thus exposing the front end face, or stopping surface 45 of tumbler 36, which would prevent movement of sliding member 12. The tumbler 36 will be allowed to rotate until protruding portion 52, as seen in FIGS. 3(*b*) and 10(*b*), and bottom surface of top plate 25 meet, as seen in FIGS. 1 and 8(*b*).

In another embodiment, rotation members 43 and 44 may be located on inside walls of 14 and 15, respectively. In this type of embodiment tumbler 36 may have apertures or bored cavities aligned along the same central axis. The rotation members will function and operate in the same manner as mentioned in the above embodiment.

Figure 3A:
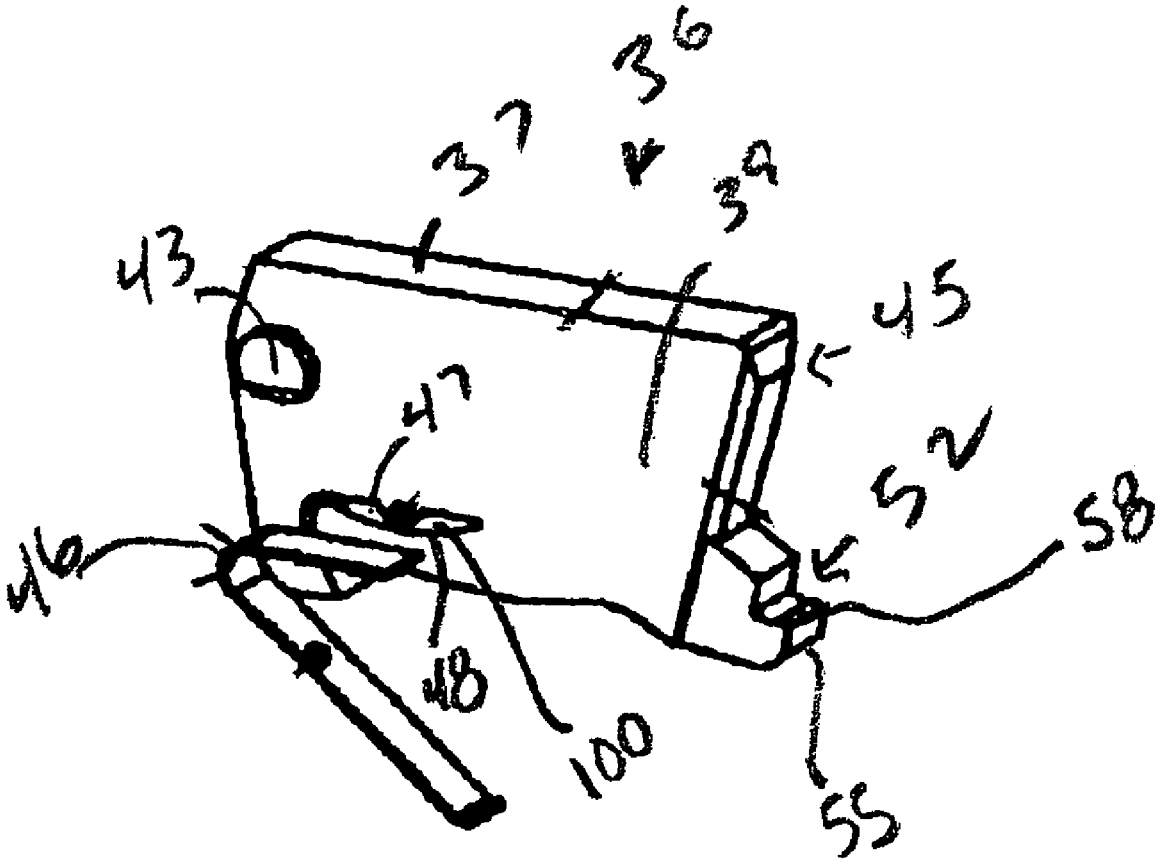
FIG. 3(*a*) is an exploded view of the tumbler and spring of the present invention.
Figure 3B:
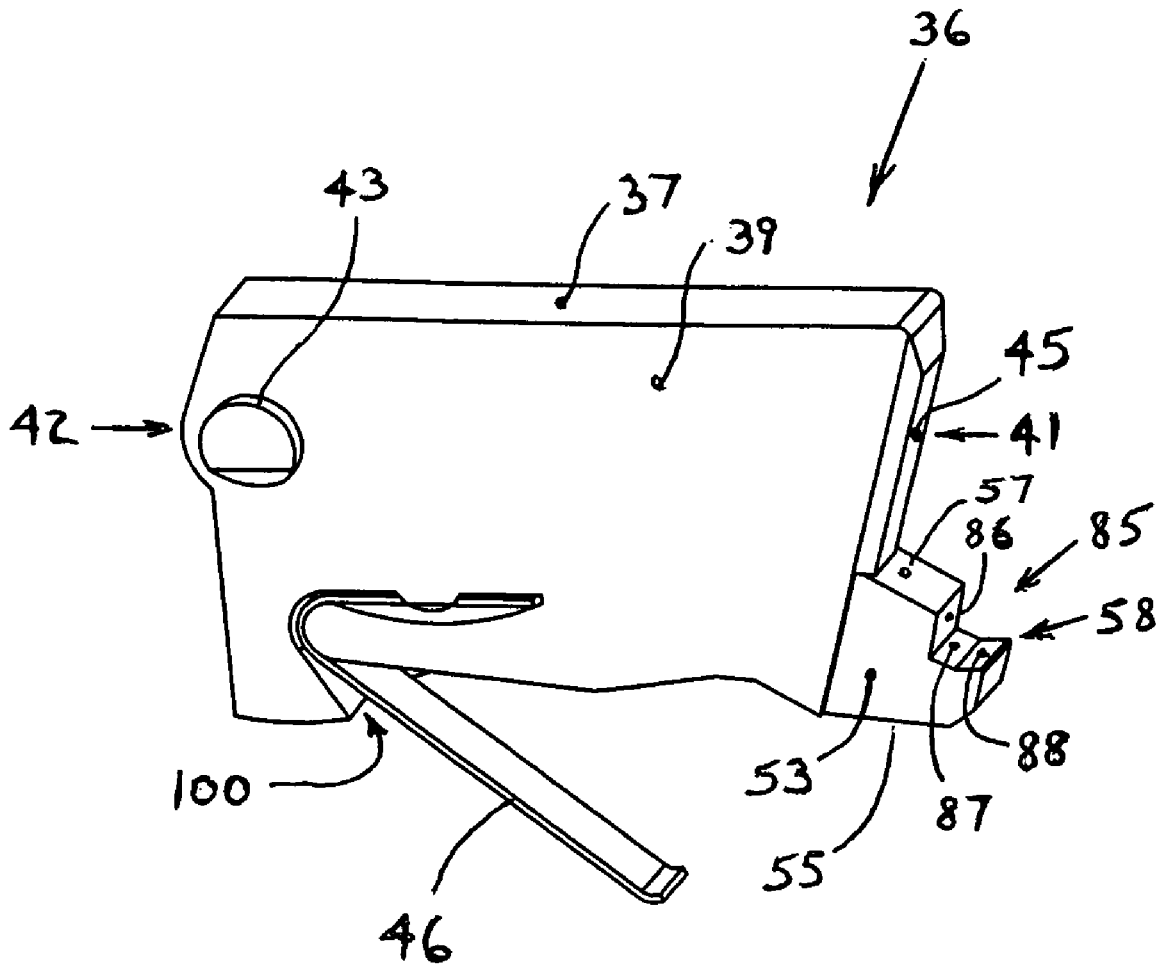

Tumbler 36 has a cavity 100 that houses the plate spring 46, as seen in FIGS. 3(*a*) and 3(*b*). However, this is not the only possible method of attaching a spring to tumbler 36. For example, one could a have a peg on the bottom surface of the tumbler for receiving a spiral spring. Tumbler cavity 100 has a top and bottom surface, 47 and 48, respectively, generally conforming to the width of plate spring 46, which the cavity houses. In the present embodiment an aperture 49 may be present on at least one side of the tumbler cavity 100, as seen in FIGS. 1 and 10(*b*). This acts as to further confine the plate spring 46 from coming dislodged from cavity 100. This aperture 49 is an added movement inhibitor and is not necessary for proper operation. Because of the tight fit between tumbler 36 and housing 13 that contains it, there is usually no need for guide members on the side surfaces 39 and 40, as in the prior art. The tumbler 36 has arcuate surface 50 on the underside thereof that interacts with a respective arcuate surface 51 of housing 13. Arcuate surface 50 is preferably located on the rear bottom of tumbler 36, and arcuate surface 51 is located on the inside rear end of the housing 13, a seen in FIG. 8(*b*). These arcuate surfaces assist in providing smooth movement of the tumbler from an activated position to a recessed position and vice versa. Tumbler 36 has a protruding portion 52 located at the bottom front end wall of tumbler 36, as seen in FIG. 3 (*b*). The protruding portion 52 has a top surface 57 that may extend generally perpendicularly from the front end face 41 of the tumbler 36. The protruding portion 52 also has two sides 53, and 54, that extends from top surface 57 toward the bottom of tumbler 36, a notch portion 85 that is formed by inside face 86,and surfaces 87 and 88. Bottom 55 of the protruding portion 52 extends outwardly in the same direction as top surface 57 so as to meet with the outside edge of surface 88 to form a tip 58, as seen in FIG. 3(*a*). The protruding portion 52 is so designed as to allow a meshing between the protruding portion 52 and the tooth 75 of button 60, as seen in FIG. 8(*a*).

Figure 9A:
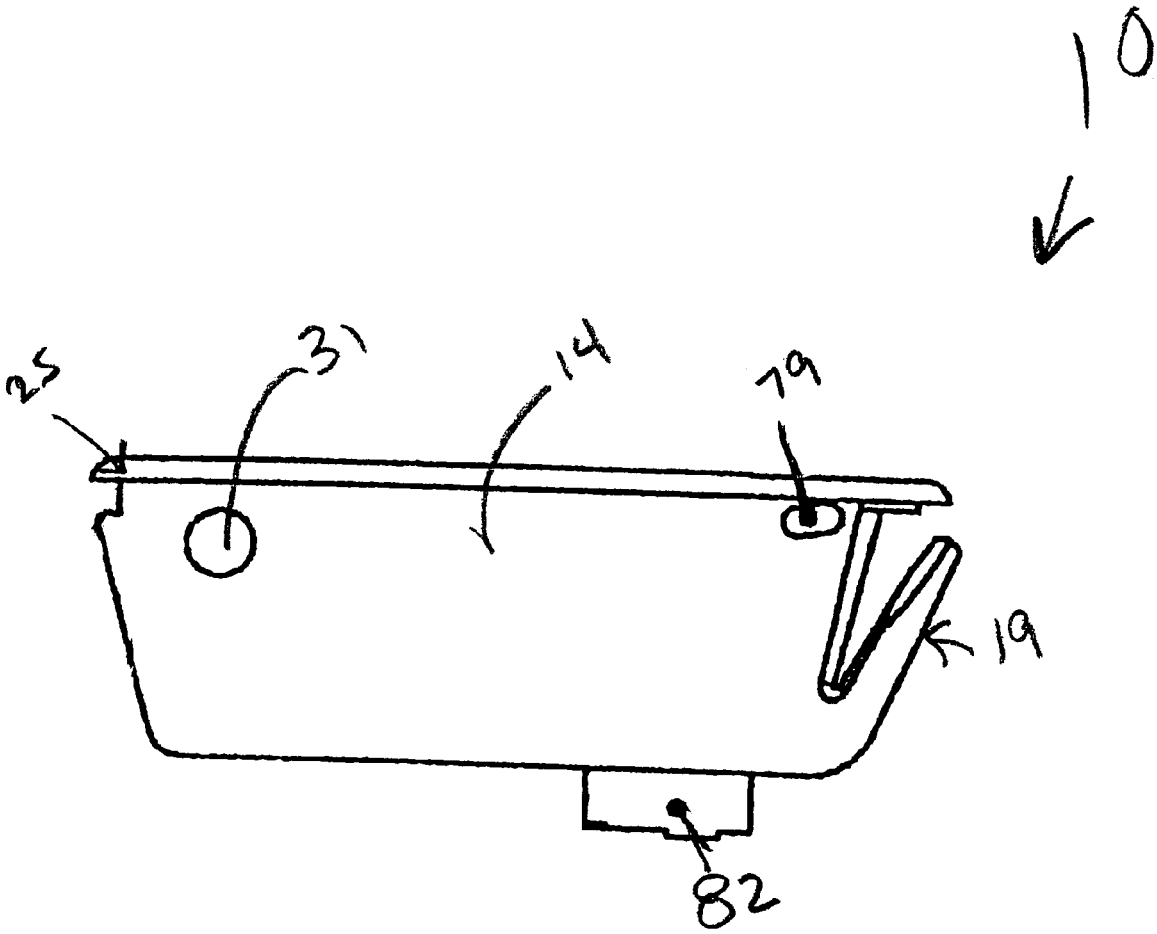
FIG. 9(*a*) is a side view of tumbler and housing, with tumbler depressed.
Figure 9B:
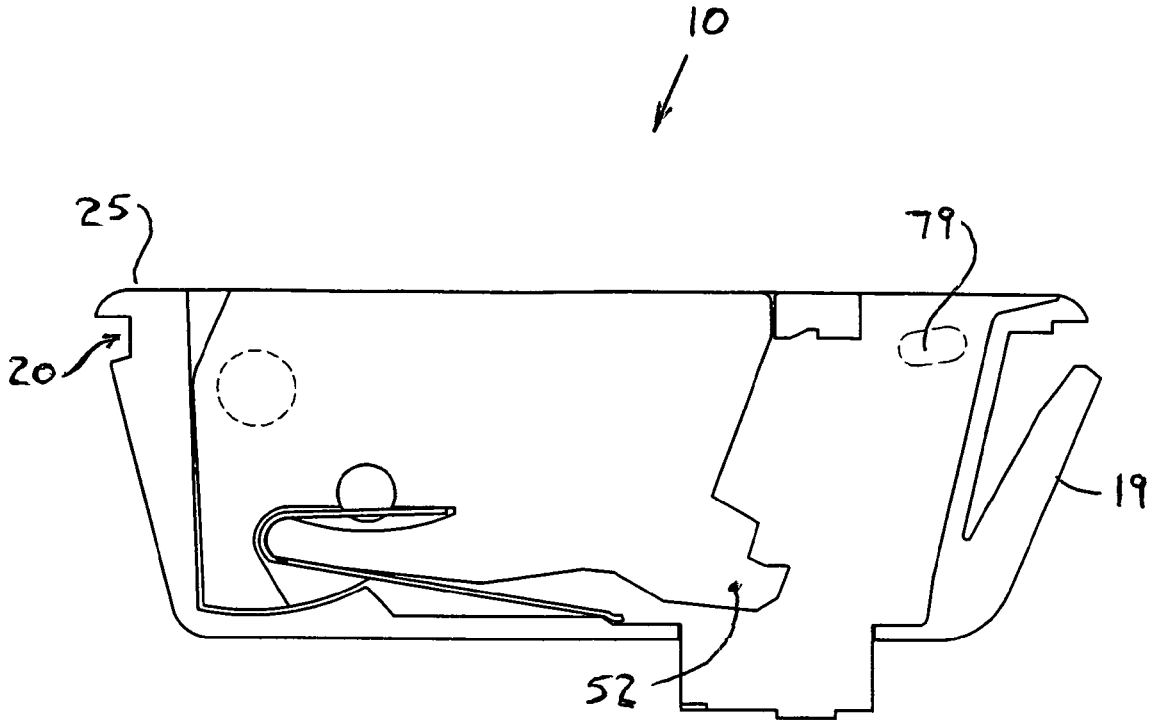

The release of the tumbler 36 from housing 13 can be controlled by an interaction between button 60 and protruding portion 52 of tumbler 36. Button 60 can have a top surface 61 which is preferably in the same plane as the upper surface 37 of the tumbler 36, as seen in FIGS. 5(*a*) and 5(*b*). Button 60 preferably resides in opening 62 of top plate 25. Here, the user can access button 60 easily. Top surface 61 of button 60 can have a groove or recess 63, where the user can engage button 60 with any suitable instrument known in the art, including but not limited to a finger, fingernail, pen, pencil etc. When the user engages groove 56, it can move button 60 within opening 62 of housing 13 and move the body 90 of the button, where the body 90 is in the form of a spring clip, so that the protruding portion 52 of tumbler 36 is no longer blocked and the tumbler 36 may move from a recessed position to an activated position. In the present embodiment the user translates groove 56 in a motion toward the front end of the housing. Button 60 as mentioned previously has a top surface 61 of the head 91, and it has a bottom portion or a spring clip body 90, where the spring clip body can best be described as having two main structures, an inner member 69 for holding tumbler 36 in housing 13 when not activated, and an outer member 70 which keeps button 60 in its original position when no force is placed on the button. Both members 69 and 70 join at the junction 68 of button 60. The inner member 69 has front and rear faces, 63 and 64, respectively, left and right sides, 65 and 66, respectively, and a top face 67 that sits just below the bottom of the top plate 25. Top protrusion 67 acts so as to keep button 60 inside of housing 13 when button 60 is translated in a downward fashion. Front and rear faces, 63 and 64, respectively, and left and right sides, 65 and 66, respectively, preferably taper in a downward fashion from top protrusion 67, a distance preferably less then that of the inside wall of housing 13, but generally equal to that of the front face of tumbler 36. The outer member 70 preferably acts as a spring and has front and rear face 71 and 72, respectively, and has left and right sides 73 and 74 respectively. The dimensions of the outer member are such dimensions so as to allow for the desired tension of button 60. At the bottom junction 68 of button 60 there exists a tooth 75 formed where members 69 and 70 join. Tooth 75 keeps protruding portion 52 of tumbler 36 in place when night latch 10 is inactive, i.e., movement of sliding member 12 is uninhibited. On left and right sides, 65 and 66, respectively, of member 69, there exists two pegs, 76 and 77, as seen in FIGS. 2 and 10(*a*). Pegs 76 and 77 could be of any suitable shape, including but not limited to a full cylinder, a partial, cylindrical shape, a hollowed cylinder, etc. In the present embodiment cylindrical pegs were used. Pegs 76 and 77 are positioned on the upper portion of member 69. Both pegs, 76 and 77, rest in apertures 78 and 79 of housing 13, as seen in FIG. 9(*a*) Apertures 78 and 79 are aligned along the same central axis and are of the shape as to allow for unimpeded translation of pegs 76 and 77. In the present embodiment oblong apertures were used.

In another embodiment pegs 76 and 77 may be located on housing 13, and member 69 may have apertures or bored cavities to receive corresponding pegs. The functionality of the pegs and apertures may serve the same function as mentioned above.

On housing 13, the bottom plate 18 may have an operable cover 82 for installing one or more parts into housing 13, as seen in FIGS. 6 (*a*) and (*b*). Any suitable shape cover can be implemented, including but not limited to a square, rectangle, circle, etc. In the present embodiment a rectangular cover and opening were used.

When the user wishes to activate tumbler 36 so as to inhibit full movement of sliding member, 12 the user will exert a force, greater then that of button portion 70, on groove 56, of button 60. This force will cause button 60 to move in a direction opposite that of the stored potential energy of button portion 70, thus causing release portion 75 of button 60 to disengage tumbler 36. When tumbler 36 is free to pivot on rotation members 43 and 44, the upward force of spring 46 will cause tumbler 36 to rotate in an outwardly direction until protruding portion 52 and bottom surface of top plate 25 meet, at which time stopping surface 45 of tumbler 36 will be exposed, thus preventing sliding window member from opening any further. When tumbler 36 is exposed, i.e. activated (see FIG. 1), and the user releases groove 63, the spring clip body 90 of button 60 will return to its original position. When the user wishes to deactivate the tumbler, the user may apply a force, in a generally perpendicular direction, to a portion of top surface 37 of tumbler 36. Application of the force to surface 37 will cause protruding portion 52 of tumbler 36 to engage surface 63 of button 60, causing the button 60 to rotate and causing relative movement between the tumbler and button, until the tip 58 of protruding portion 52 on the tumbler has moved past the tooth 75 of button 60. At this time, release of the force upon surface 37 of tumbler 36 will permit tooth 75 of button 60 to engage the tip 58 of tumbler 36, and retain the tumbler within housing 13.

As various changes could be made in the above constructions without departing from the scope of the invention, it is intended that all matter contained in the above description shall be interpreted as illustrative and not in a limiting sense. In the view above it will be seen that several objects of the invention are achieved and other advantageous results attained, as defined by the scope of the following claims.

We claim:

1. A latch, placed in a recess of a window or door to limit door or window movement, where said latch comprises: a housing, said housing having a top surface, at least two side surfaces extending from said top surface, and a bottom surface extending from at least a portion of one side surface to at least a portion of the other side surface, said housing having a tumbler pivotally mounted in said housing said tumbler capable of occupying a recessed position where said tumbler is within the housing and an activated position wherein at least a portion of said tumbler extends from an opening in the top surface of said housing, said tumbler being biased by a spring means to said activated position; said tumbler having an upper surface, a lower surface, a front end and a rear end, said tumbler being retained in a recessed position in said housing by an actuating means, said actuating means comprising a button pivotally mounted in said housing and moveable between a first and a second button positions, said button comprising a top member with a top and bottom surface, a body member extending from said bottom surface of said top member, and a flexing member attached to said body member at an end opposed to said bottom surface and extending from said end toward said bottom surface; said top, body, and flexible member being a continuous member; said top member of said button moving said body member of said button from a first position, where said body member retains said tumbler in its recessed position to a second position where said tumbler is released and said tumbler is permitted to pivot to an activated position, and where said spring member of said button forces said body member of said button to said first position when said tumbler has been released, said tumbler in said activated position being capable of resisting rotating back into said retracted position.

2. The latch according to claim 1, wherein said tumbler has a protrusion extending from said front end of said tumbler and wherein said actuating means contacts a surface of said protrusion and prevents said tumbler from moving from said recessed position to said actuated protrusion until a portion of said actuating means is removed from contact with said protrusion.

3. The latch according to claim 2, wherein said protrusion is located on said front end of said tumbler where said front end meets said lower surface.

4. The latch according to claim 3, wherein said protrusion has a notch for receiving a portion of said actuating means.

5. The latch according to claim 4, wherein said actuating means has a button head and an inner member extending from an underside of said button head, said inner member having a surface that contacts a surface of said protrusion and prevents movement of said tumbler to an activated position.

6. The latch according to claim 5, wherein said outer member of said actuating means is comprised of resilient material, and wherein said resilient outer member extends from said inner member.

7. The latch according to claim 6, wherein said inner member has a first end and a second end, said first end being connected to said button head, and said outer resilient structure being connected to said second end of said inner structure.

8. The latch according to claim 7, wherein said outer resilient member having a free end.

9. The latch according to claim 8, wherein said inner member and said outer resilient member forms a generally "V" shaped configuration.

10. The latch according to claim 9, wherein the outer resilient member contacts an inner surface of the front end of said housing when said button is moved to activate the tumbler.

11. The latch according to claim 3 wherein said protrusion has a first top surface, a side surface extending from said top surface, a second top surface extending from an end of said side surface opposite said first top surface.

12. The latch according to claim 11, wherein said second top surface has a second side surface extending from said second top surface.

13. The latch according to claim 12, wherein said protrusion has a bottom surface extending from the bottom surface of said tumbler to said second side surface.

14. The latch according to claim 1, wherein the rear end of said tumbler has a portion extending past said bottom end of said tumbler, said rear end of said tumbler having an arcuate section extending from said rear end toward the front end of said tumbler.

15. The latch according to claim 14, wherein said button of said housing has an inner surface with an arcuate section that corresponds to the arcuate section on said tumbler.

16. The latch according to claim 1 wherein said button moves from said second position to said first position when said button is released.

17. A latch, placed in a recess in a window or door to limit door or window movement, said latch comprising:

(a) a housing, said housing having a front face, a cavity, one or more openings into said cavity, and at least one opening in said front face to said housing cavity;

(b) a tumbler, said tumbler having a front end and a rear end, said rear end of said tumbler being pivotally mounted to said housing, said tumbler being sized and shaped so it may occupy a retracted position within said housing cavity and an activated position wherein at least a portion of said tumbler front end extends from said opening of said housing;

(c) a spring means, said spring means biasing said tumbler to said activated position;

(d) an actuation means, said actuation means being pivotally mounted to said housing and capable of pivoting from an engaged position to a disengaged position; said actuation means comprising a button portion and a body portion, said body portion comprising a spring member extending from an end of said body portion opposed to said button portion and extending from said end toward said button portion, said button portion, body portion and said spring member being a continuous member, said spring member biasing said actuation means toward said engaged position, said button portion having a surface exposed through a housing opening such that said button may be toggled to counter said biasing of said spring member and pivot said actuation means from said engaged position to said disengaged position; said actuation means capable of co-acting with said tumbler to retain said tumbler in said retracted position until said actuation means is toggled to said disengaged position where said tumbler is then biased by said spring means into said activated position; said tumbler in said activated position being capable of resisting rotation back into said retracted position.

18. The latch according to claim 17, wherein said housing is comprised of: a top plate, said top plate having an opening; first and second sidewalls, said first and second sidewalls extending from said top plate; and a bottom wall, said bottom wall extending from at least a portion of said first sidewall to at least a portion of said second sidewall.

19. The latch according to claim 18, wherein said bottom wall of said housing comprises a removable cover.

20. the latch according to claim 18, wherein said housing includes front and rear walls, said front and rear walls each connecting an end of said first sidewall to an end of said second sidewall.

21. The latch according to claim 20, wherein said front wall contains a flexible clip.

22. The latch according to claim 21, wherein said rear wall has a notch.

23. The latch according to claim 21, wherein said rear wall contains a flexible clip.

24. The latch according to claim 17, wherein said spring means is a leaf spring.

25. The latch according to claim 24, wherein said leaf spring has a first leg and a second leg, said first and said second legs being connected by a curved portion.

26. The latch according to claim 25, wherein said first and second leaf spring legs are at an acute angle.

27. The latch according to claim 17, wherein said tumbler has an opening for mounting at least a portion of said first leg of said leaf spring.

28. The latch according to claim 17, wherein said tumbler has one or more cylindrical pins protruding from said rear end of said tumbler to permit pivotal mounting of said tumbler in said housing.

29. The latch according to claim 17, wherein said tumbler front end has a protrusion for co-action with said actuation means to retain said tumbler in said retracted position.

30. The latch according to claim 29, wherein said protrusion of said tumbler also limits travel of said tumbler into said activated position upon contact with a portion of said housing.

31. The latch according to claim 29, wherein said actuation means has a protrusion for co-action with said tumbler protrusion to retain said tumbler in said retracted position when said actuation means is in said engaged position.

32. The latch according to claim 17, wherein one or more cylindrical pins protrude from said actuation means to permit pivotal mounting of said actuation means in said housing.

33. The latch according to claim 17, wherein said body of said actuation means further comprises a protrusion for co-action with said housing to limit travel of said actuation means in the engaged position.

34. The latch according to claim 17, wherein said integral spring clip is generally V-shaped, with one leg of the V-shape being constructed of a resilient material.

35. The latch according to claim 34, wherein said V-shaped spring clip biases said actuation means into said engaged position by contact of said resilient leg of said spring clip with said housing.

36. A latch, placed in a recess in a window or door to limit door or window movement, where said latch comprises: a housing, said housing having a top surface, at least two side surfaces extending from said top surface, and a bottom surface extending from at least a portion of one side surface to at least a portion of the other side surface; said housing having a tumbler pivotally mounted in said housing, said tumbler capable of occupying a recessed position where said tumbler is within the housing, and an activated position wherein at least a portion of said tumbler extends from an opening in the top surface of said housing, said tumbler being biased by a spring means to said activated position; said tumbler having an upper surface, a lower surface, a front end and a rear end, said front end being generally straight with at least a portion of said front end forming at an acute angle with said top surface, said front end also comprising one or more protrusions on at least a portion of said generally straight front end; said tumbler being retained in said recessed position in said housing by an actuating means; said actuating means comprising a button pivotally mounted in said housing and moveable between a first and a second button positions, said button comprising a top member with a top and bottom surface, a body member extending from said bottom surface of said top member, and a spring member extending from said body member at a location opposed to said bottom surface and extending from said location toward said bottom surface, said top, body and spring member being a continuous member, said top member of said button moving said body member of said button from a first position, where said body member retains said tumbler in its recessed position to a second position where said tumbler is released and said tumbler is permitted to pivot to an activated position, and wherein said spring member forces said body member of said button to said first position when said tumbler has been released, said tumbler in said activated position being capable of resisting rotation back into said retracted position when a force is applied to said tumbler front end.

37. A latch, placed in a recess of a window or door to limit door or window movement, where said latch comprises: a housing, said housing having a top surface, at least two side surfaces extending from said top surface, and a bottom surface extending from at least a portion of one side surface to at least a portion of the other side surface, said housing having a tumbler pivotally mounted in said housing said tumbler capable of occupying a recessed position where said tumbler is within the housing and an activated position wherein at least a portion of said tumbler extends from an opening in the top surface of said housing, said tumbler being biased by a spring means to said activated position; said tumbler having an upper surface, a lower surface, a front end and a rear end, said tumbler being retained in a recessed position in said housing by an actuating means, said actuating means comprising a button pivotally mounted in said housing and moveable between a first and a second button positions, said button comprising a top surface and a bottom surface said bottom surface having a body member extending therefrom, said body member having a first end and a second end; said first end extending from said bottom surface, said second end having a flexible member extending therefrom and toward said button surface, said button, said body member and said flexible member are a single member, said top surface of said button moving said body member from a first position, where said body member retains said tumbler in its recessed position to a second position where said tumbler is released and said tumbler is permitted to pivot to an activated position, and where said flexible member of said button forces said body member to said first position when said tumbler has been released, said tumbler in said activated position being capable of resisting rotating back into said retracted position.

38. The latch according to claim 37 wherein said body member has a first side and a second side and wherein said flexible member extends along said first side but is separated therefrom.

39. The latch according to claim 38 wherein said second side of said body member is opposite said first side and has a tooth extending therefrom.

40. The latch according to claim 39 wherein said tooth is located at the end of said body member opposite said top surface of said button.

41. The latch according to claim 40 wherein said housing is further comprised of a front and rear end, and said button is moved from said first position to said second position by applying a force to the top surface in a direction towards said front end of said housing.

* * * * *